United States Patent [19]

Van Riesen

[11] Patent Number: 4,809,410

[45] Date of Patent: Mar. 7, 1989

[54] BELT LOCK FOR A BELT STRAP SAFETY SYSTEM

[75] Inventor: Reiner Van Riesen, Elmshorn, Fed. Rep. of Germany

[73] Assignee: Van Risen & Co., Pinneberg, Fed. Rep. of Germany

[21] Appl. No.: 77,376

[22] Filed: Jul. 24, 1987

[30] Foreign Application Priority Data

Aug. 2, 1986 [DE] Fed. Rep. of Germany ... 8620861[U]

[51] Int. Cl.[4] ..... A44B 11/25

[52] U.S. Cl. ..... 24/574; 24/633

[58] Field of Search ..... 24/573, 574, 633, 588, 24/572; 297/468, 483, 484; 280/801, 808

[56] References Cited

U.S. PATENT DOCUMENTS

| | | | |
|---|---|---|---|
| 3,034,596 | 5/1962 | Twaits, Jr. | 24/572 X |
| 3,304,119 | 2/1967 | Boedigheimer | 24/572 X |
| 3,925,853 | 12/1975 | Nicklin | 297/483 X |
| 4,606,552 | 8/1986 | Hultqvist | 24/573 X |

FOREIGN PATENT DOCUMENTS

| | | | |
|---|---|---|---|
| 137374 | 4/1985 | European Pat. Off. | 24/573 |
| 225719 | 6/1987 | European Pat. Off. . | |
| 3043432 | 6/1982 | Fed. Rep. of Germany | 24/633 |
| 8230071 | 9/1983 | Fed. Rep. of Germany . | |

*Primary Examiner*—Kenneth J. Dorner
*Assistant Examiner*—James R. Brittain
*Attorney, Agent, or Firm*—Balogh, Osann, Kramer, Dvorak, Genova & Traub

[57] ABSTRACT

A belt lock for a belt strap safety system comprising a lock case incorporating a detent mechanism, a lock tongue insertible into the lock case and engageable with the detent mechanism, one or two shoulder strap end pieces each having a carrier element for a shoulder strap to be fastened thereto and a crotch strap end piece for attachment to a crotch strap. Each of the end pieces has an attachment element for retention on the lock tongue and the attachment elements have complimentarily shaped free ends by which the shoulder and crotch strap end pieces can engage and fit together independently of the lock tongue. The lock is assembled by fitting together the attachment elements and then passing the lock tongue through the assembled elements and into the lock case.

8 Claims, 2 Drawing Sheets

FIG. 1
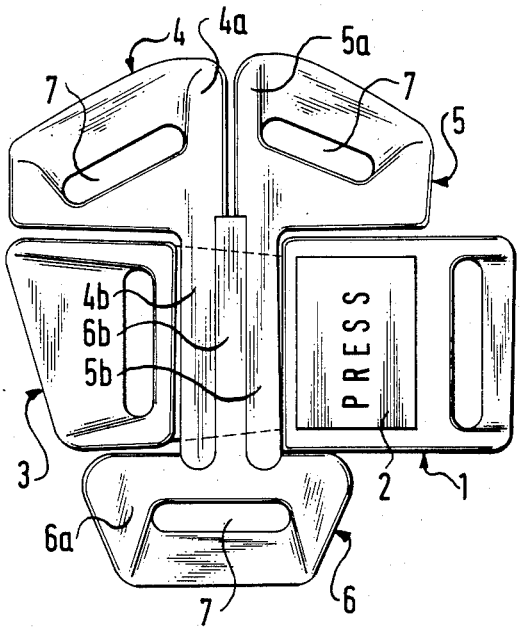
FIG. 3
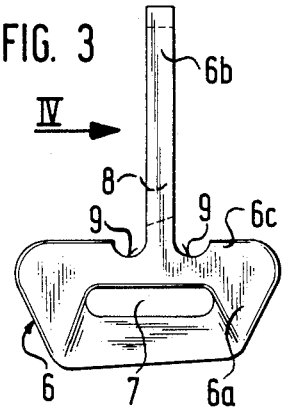
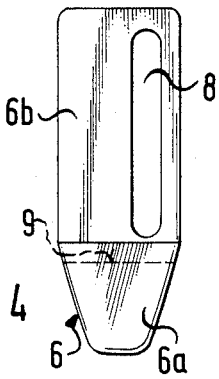
FIG. 4
FIG. 2
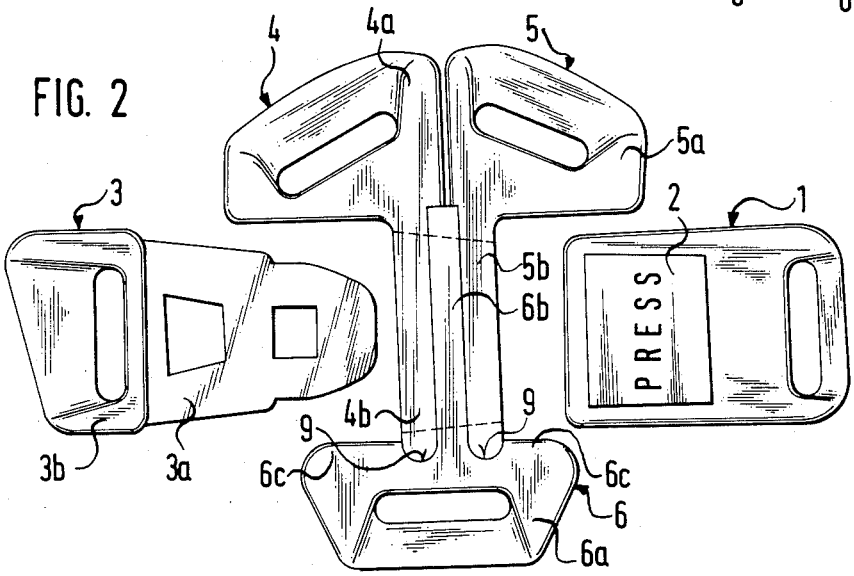

BELT LOCK FOR A BELT STRAP SAFETY SYSTEM

BACKGROUND OF THE INVENTION

1. Field of the Invention

The invention relates to a belt lock for a belt strap safety system, of the type comprising a lock case incorporating a detent mechanism, a lock tongue insertible into the lock case and engageable with the detent mechanism, at least one end piece for a shoulder strap which is to be fastened thereto and another end piece for a crotch strap which is to be fastened thereto, the end pieces having a carrier element for the straps and an attachment element for their plug-in type retention on the lock tongue.

2. Description of the Prior Art

Belt locks are known for belt strap safety systems which comprise a supplemental system for the fastening of a crotch strap. This system is produced as an integral and projecting component of the lock case, meaning that the frame or the like of the same has a projecting reception element on which is attached the plate-like end piece for the crotch strap. The lock tongue also has a locking extension to secure the crotch strap end piece attached against dropping off when the belt lock is shut. This known belt lock has comparatively large dimensions and requires considerable care upon clipping its main parts together, if all the components are to be attached in the correct positions.

A belt lock is known furthermore, in which the attaching section of the crotch strap end piece is attached to the somewhat elongated lock tongue together with the shoulder strap end pieces. Upon doing so, the case may arise however, that the end pieces are attached on the lock tongue in the wrong order, thereby failing to ensure the functional reliability of the lock, particularly opening. The joining together or attachment of these end pieces is difficult and time-consuming moreover because of the absence of a mandatory fitting sequence of the end pieces.

SUMMARY OF THE INVENTION

It is an object of the invention to provide an improved belt lock of the kind referred to in the foregoing, wherein with a compact structure the positionally correct fitting of the strap belt end pieces on the lock tongue is ensured positively in an uncomplicated manner and wherein a cohesion of all end pieces required for attachment is established prior to attaching the end pieces on the lock tongue.

This object is achieved in accordance with the invention in that the free extremity of the attachment portion of the end piece for the shoulder strap and the carrier element interengages with the end piece for the crotch strap.

In a preferred embodiment of the invention, the carrier portion of the crotch strap end piece has at least one excision, the or each excision of the carrier portion being provided adjacent to the attachment portion of this end piece. The or each excision is formed in the shape of a transverse groove, preferably of semicircular cross-section.

A further development of the belt lock in which two shoulder strap end pieces are provided and the lock tongue is provided with a rapid shifting device if appropriate, the attachment portion of the crotch strap end piece is provided between the attachment portions of the two shoulder strap end pieces and these two attachment portions are set back a little from the mutually opposed extremities of the corresponding carrier portions. To this end, the arm-like attachment portion of the crotch strap end piece is preferably situated in the end region facing towards the lock tongue of the transversely extending carrier portion of this end piece.

The positionally correct co-ordination of the belt strap end pieces with each other, inclusive of the crotch trap end piece, is predetermined in this way so that the end pieces may be attached to the attachment portion of the lock tongue in a particular sequence only. It is assured thereby that the belt lock is securely closed and may be opened rapidly. Furthermore, thanks to the predetermined position of the belt strap end pieces with respect to each other even before their attachment to the lock tongue, it is ensured that, apart from the correct position of the end pieces, an easy and rapid attachment of the belt strap end pieces on the lock tongue is also obtained. The belt lock remains compact in its structural form moreover, so that it is particularly appropriate for child restraint systems, mainly in motor vehicles.

Further features and advantages of the invention will become apparent from the following detailed description, taken in conjunction with the accompanying drawings which illustrate preferred embodiments thereof.

BRIEF DESCRIPTION OF THE DRAWINGS.

FIG. 1 shows a plan view of a first embodiment of the invention;

FIG. 2 shows a plan view, of the embodiment of FIG. 1 shown partially drawn apart;

FIG. 3 shows a plan view of an end piece of the belt lock of FIG. 1;

FIG. 4 shows a side view corresponding to the arrow IV in FIG. 3 and

Figure 5:
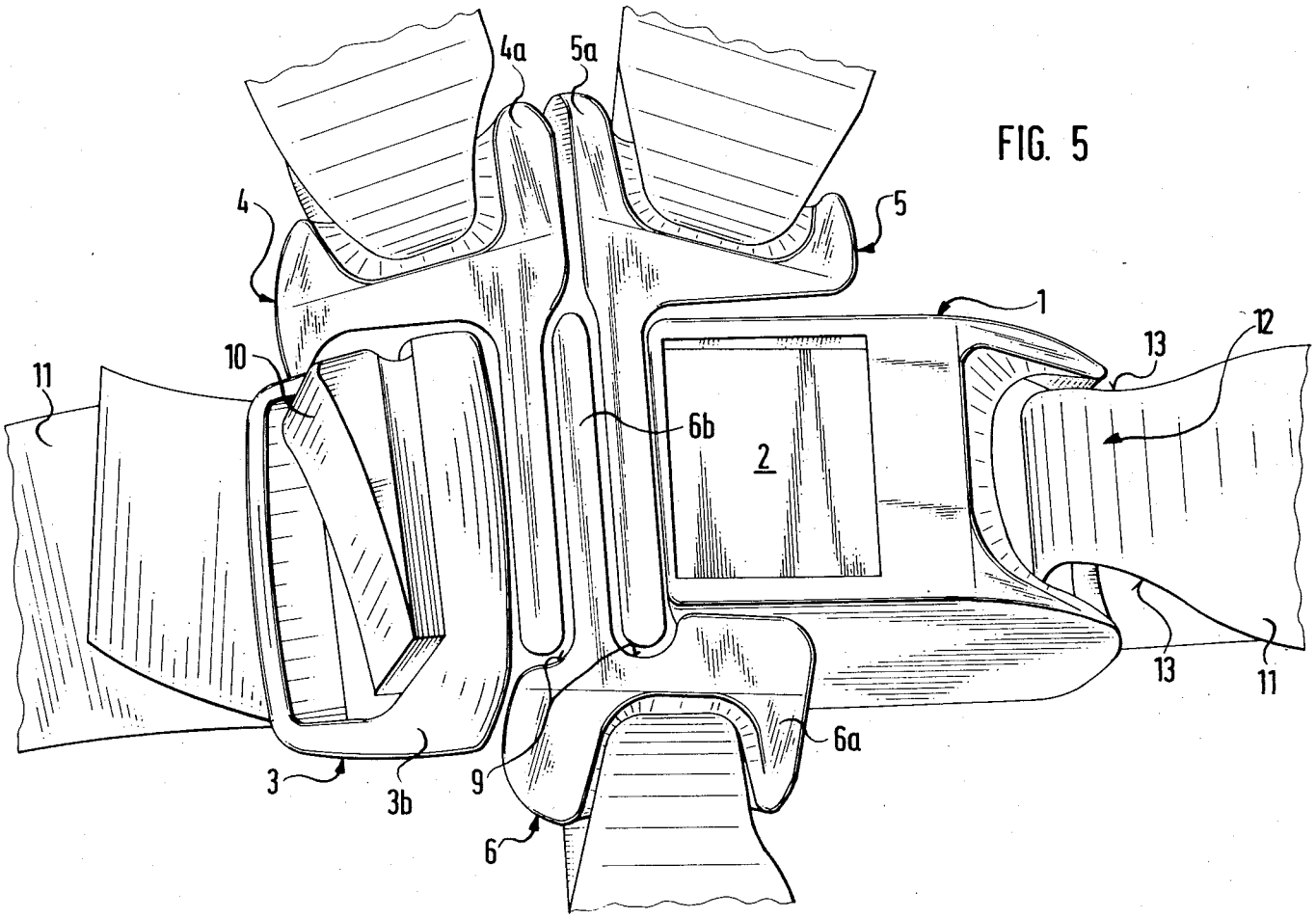
FIG. 5 shows a plan view of a second embodiment.

DETAILED DESCRIPTION OF THE PREFERRED EMBODIMENTS.

Referring to FIG. 1, there is shown a belt lock fitted together with a belt strap safety system of a type commonly used in motor vehicles. The lock comprises a lock case which encloses a detent mechanism which is of a generally known type and of which only the release press button 2 is visible. The lock also comprises a lock tongue 3 insertible into the lock case and engageable with the mechanism in a conventional manner, two end pieces 4 and 5 for the two shoulder straps and another end piece 6 for a crotch strap, the straps themselves not being illustrated. Each of the end pieces 4,5 and 6 again comprises a carrier portion 4*a*, 5*a* and 6*a* for the belt straps which are to be installed thereon in a known manner, and an arm-shaped attachment portion 4*b*, 5*b* and 6*b*, the later portions being attached on a portion 3*a* of the lock tongue 3 as can be seen in FIGS. 1 and 2. The portions 4*a*, 5*a* and 6*a* are each provided with a slot 7 for traversal by the belt straps. The other portions 4*b*, 5*b* and 6*b* are also provided with slots through which is passed the portion 3*a* of the lock tongue 3, such a slot 8 of the section 6*b* being most clearly apparent from FIG. 4.

Instead of having two individual end pieces 4 and 5 for the shoulder straps, it is also possible for both carrier portions 4*a* and 5*a* to be situated on a common attachment portion (not shown).

As is most clearly apparent from FIG. 3, the carrier portion 6*a* of the crotch strap end piece 6 has two excisions 9 in its peripheral area 6*c* facing towards the attachment portion 6*b*. These excision are produced in the form of grooves extending transversely to the longitudinal extension of the carrier portion 6*a*. They preferably have a semicircular cross-section and are so arranged that an excision 9 is situated on either side of the attachment portion 6*b*, that is to say directly adjacent to this attachment portion.

If the aforesaid alternate shoulder strap end piece is utilised with one common attachment portion only, evidently one excision 9 only need be provided, that is to say in the peripheral area 6*c* on one side or the other of the attachment portion 6*b*.

As is clearly apparent from FIGS. 1 and 2, the free extremity of the attachment portions 4*b* and 5*b* fits in each case into the excisions 9. To this end, the free extremities are appropriately matched to the shape of the excisions 9. In combination with the fact that the slot 8 of the portion 6*b* and the corresponding slots of the portions 4*b* and 5*b* are arranged offset with respect to the longitudinal centre of these portions (FIG. 4), the result is a predetermined sequence in which the end pieces 4,5 and 6 must be assembled before they can be attached on the lock tongue, so that incorrect attachment is prevented. The excisions 9 have the effect moreover that the assembled end pieces as such already display some degree of cohesion, so that the end pieces may be attached on the lock tongue 3 reliably and more rapidly, by hand.

As shown in FIGS. 1 and 2 and also FIG. 3, the attachment portions 4*b* and 5*b* of the end pieces 4 and 5 extend from respective end regions of the carrier portions 4*a* and 5*a*, the two terminal areas facing towards each other. The attachment portions are however set back a little in position, in each case by half the thickness of the attachment portion 6*b* of the end piece 6, so that the portion 6*b* is placed precisely between the two other portions 4*b* and 5*b*. This mode of construction leads to a compact layout of the portions 4*a* and 5*a*

FIGS. 1,2 and 3 show furthermore that the attachment portion 6*b* of the end piece 6 is situated at or about the middle of the carrier portion 6*a* of this end piece. In the embodiment shown in FIG. 5, the attachment portion 6*b* may however also be provided in the end region of the carrier portion 6*a* which faces towards the carrier portion 3*b* of the lock tongue 3. This embodiment is advantageous if a rapid displacement device denoted by 10 in FIG. 5, which may be of known type, is formed integrally with the carrier portion 3*b* of the lock tongue 3. In view of the provision of the rapid displacement device, it should be possible to pull the whole width of the lap strap 11 through the rapid displacement device, so that a correspondingly wide carrier portion 3*b* is required, which is wider than the lock case 1 because the loop 12 of the lap strap 11 secured thereon is folded over in a known manner as indicated at 13. Thanks to the eccentric positioning of the attachment portion 6*b* according to FIG. 5, the compact form-of construction of the belt lock as a whole is retained as is clearly shown by this Figure.

The operation of a belt lock of similar type to those described in the foregoing is generally known, so that a very brief explanation only is needed in this connection. The end pieces 4,5 and 6 are first joined together as per FIG. 2 and then jointly attached on the lock tongue 3, which is slid through all three and then inserted into the lock case 1 and interlocked with the detent mechanism present therein.

What is claimed is:

1. A belt lock for a belt strap safety system, comprising a lock case incorporating a detent mechanism, a lock tongue insertible into the lock case and engageable with said detent mechanism, a shoulder strap end piece having means for fastening a shoulder strap thereto and a crotch strap end piece having means for fastening a crotch strap thereto, said end pieces each having further an attachment element for their retention on the lock tongue, said attachment element of said shoulder strap end piece has a complementarily-shaped free end to enable said shoulder and crotch strap end pieces to engage and fit together, the means for fastening a crotch strap of said crotch strap end piece is provided at a peripheral portion thereof facing towards its attachment element with an excision in which said free end of the attachment element of said shoulder strap end piece engages, and said excision of the strap fastening means of the crotch strap end piece is positioned adjacent to the attachment element of this end piece, in order to minimize the distance between the attachment elements to each other.

2. A belt lock as claimed in claim 1, wherein said excision is in the form of a transverse groove.

3. A belt lock as claimed in claim 2, wherein said groove is of semi-circular cross-section.

4. A belt lock as claimed in claim 1, wherein said lock tongue is provided with a rapid shift system and the attachment element of said crotch strap end piece stems from the end portion facing towards the lock tongue of the strap fastening means of said end piece, to allow said system to be positioned near to the attachment element opposite to it.

5. A belt lock for a belt strap safety system, comprising a lock case incorporating a detent mechanism, a lock tongue insertible into the lock case and engageable with said detent mechanism, two shoulder strap end pieces having means for fastening a shoulder strap thereto and a crotch strap end piece having means for fastening a crotch strap thereto, said end pieces each having further an attachment element for their retention on the lock tongue, said attachment elements of said shoulder strap end pieces have complementarily-shaped free ends to enable said shoulder and crotch strap end pieces to engage and fit together, the means for fastening a crotch strap of said crotch strap end piece is provided at both peripheral portions thereof facing toward its attachment element with one excision on each peripheral portion in which excisions said free end of the attachment elements of said two shoulder strap end pieces engages, the excisions being positioned adjacent to the attachment element of this end piece, and the attachment element of the crotch strap end piece being arranged between the attachment elements of the two shoulder strap end pieces, and said shoulder strap attachment elements each have a recess means for receiving the crotch strap end piece and which define walls set back from mutually contacting faces of the shoulder strap fastening means in order to give a compact overall structure of the strap fastening means of the shoulder strap end pieces.

6. A belt lock as claimed in claim 5, wherein said excisions are in the form of a transverse groove.

7. A belt lock as claimed in claim 6, wherein said grooves are of semi-circular cross-section.

8. A belt lock as claimed in claim 5, wherein said lock tongue is provided with a rapid shift system and the attachment element of said crotch strap end piece stems from the end portion facing towards the lock tongue of the strap fastening means of said end piece to allow said system to be positioned near to the attachment element opposite to it.

* * * * *